US008164403B2

(12) United States Patent
Li

(10) Patent No.: US 8,164,403 B2
(45) Date of Patent: Apr. 24, 2012

(54) DISCONNECT MECHANISM IN A POWER RECEPTACLE WITH GROUND-FAULT CIRCUIT INTERRUPTION FUNCTIONS

(75) Inventor: Cheng-li Li, Shanghai (CN)

(73) Assignee: Bingham McCutchen LLP, Washington, DC (US)

( * ) Notice: Subject to any disclaimer, the term of this patent is extended or adjusted under 35 U.S.C. 154(b) by 312 days.

(21) Appl. No.: 12/412,719

(22) Filed: Mar. 27, 2009

(65) Prior Publication Data

US 2009/0256661 A1 Oct. 15, 2009

(51) Int. Cl.

| | |
|---|---|
| ***H01H 75/00*** | (2006.01) |
| ***H01H 73/12*** | (2006.01) |
| ***H01H 73/00*** | (2006.01) |
| ***H01H 83/06*** | (2006.01) |

(52) U.S. Cl. ..... 335/18; 335/6; 335/21; 335/26; 335/155; 335/165; 335/166; 335/167; 335/172; 335/185; 335/202; 361/42

(58) Field of Classification Search ..... 335/6, 18, 335/21, 26, 68, 106–107, 131–132, 155, 335/165–176, 185–192, 202; 361/42–51
See application file for complete search history.

(56) References Cited

U.S. PATENT DOCUMENTS

| | | | |
|---|---|---|---|
| 3,766,434 | A | 10/1973 | Sherman |
| 4,051,544 | A | 9/1977 | Vibert |
| 4,159,499 | A | 6/1979 | Bereskin |
| 4,421,959 | A | 12/1983 | Chen et al. |
| 4,442,470 | A | 4/1984 | Misencik |
| 4,595,894 | A | 6/1986 | Doyle et al. |
| 4,616,117 | A | 10/1986 | Kleine |
| 4,618,907 | A | 10/1986 | Leopold |
| 5,418,678 | A | 5/1995 | McDonald |
| 5,546,266 | A | 8/1996 | Mackenzie et al. |
| 5,594,398 | A | 1/1997 | Marcou et al. |
| 5,600,524 | A | 2/1997 | Neiger et al. |
| 5,831,395 | A | 11/1998 | Mortimer et al. |
| 6,040,967 | A | 3/2000 | DiSalvo |
| 6,246,558 | B1 | 6/2001 | DiSalvo et al. |
| 6,282,070 | B1 | 8/2001 | Ziegler et al. |
| 6,381,112 | B1 | 4/2002 | DiSalvo |
| 6,437,953 | B2 | 8/2002 | DiSalvo et al. |
| 6,646,838 | B2 | 11/2003 | Ziegler et al. |
| 6,657,834 | B2 | 12/2003 | DiSalvo |
| 6,671,145 | B2 | 12/2003 | Germain et al. |
| 6,693,779 | B2 | 2/2004 | DiSalvo |
| 6,717,782 | B2 | 4/2004 | DiSalvo et al. |
| 6,720,872 | B1 | 4/2004 | Engel et al. |
| 6,734,769 | B1 | 5/2004 | Germain et al. |
| 6,771,152 | B2 | 8/2004 | Germain et al. |
| 6,813,126 | B2 | 11/2004 | DiSalvo et al. |
| 6,828,886 | B2 | 12/2004 | Germain et al. |

(Continued)

*Primary Examiner* — Mohamad Musleh
(74) *Attorney, Agent, or Firm* — Bingham McCutchen LLP

(57) ABSTRACT

A disconnect mechanism for a power receptacle, which includes a disconnect block, a locking member slidably coupled to the disconnect block, and an electromagnetic device moveably coupled to the locking member. The disconnect block includes two side arms extending outwards. A pressing plate is disposed above the disconnect block, and a disconnect spring is disposed above the pressing plate. The moveable contact arms of the main switch of the receptacle are disposed between the pressing plate and the disconnect block, and the pressing plate pushes the moveable contact arms when the main switch is being opened when a current leakage is detected. The receptacle also includes an auxiliary switch disposed because the disconnect block and the circuit board.

7 Claims, 7 Drawing Sheets

U.S. PATENT DOCUMENTS 6,864,766 B2 3/2005 DiSalvo et al.
6,864,769 B2 3/2005 Germain et al.
6,873,231 B2 3/2005 Germain et al.
6,900,972 B1 5/2005 Chan et al.
6,930,574 B2 * 8/2005 Gao ..... 335/18
6,937,451 B2 8/2005 Ulrich et al.
6,944,001 B2 9/2005 Ziegler et al.
6,954,125 B2 10/2005 Wu et al.
6,975,192 B2 12/2005 DiSalvo
6,975,492 B2 12/2005 DiSalvo
6,982,856 B2 1/2006 Berstein
7,009,473 B2 3/2006 Zhang
7,031,125 B2 4/2006 Germain et al.
7,042,688 B2 5/2006 Chan et al.
7,049,910 B2 5/2006 Campolo et al.
7,088,205 B2 8/2006 Germain et al.
7,098,761 B2 8/2006 Germain et al.
7,154,718 B1 12/2006 Finlay, Sr. et al.
7,164,564 B1 1/2007 Finlay, Sr. et al.
7,173,799 B1 2/2007 Weeks et al.
7,184,250 B2 2/2007 Bonilla et al.
7,195,500 B2 3/2007 Huang et al.
7,212,386 B1 5/2007 Finlay, Sr
7,227,435 B2 6/2007 Germain et al.
7,253,629 B1 8/2007 Richards et al.
7,256,973 B1 8/2007 Radosavljevic et al.
7,265,956 B2 9/2007 Huang
7,271,987 B1 9/2007 Zhang et al.
7,289,306 B2 10/2007 Huang et al.
7,295,415 B2 11/2007 Huang et al.
7,315,437 B2 1/2008 Bonilla et al.
7,443,309 B2 10/2008 Baldwin et al.
7,492,558 B2 2/2009 Germain et al.
7,498,909 B2 3/2009 Zhang et al.
7,525,441 B2 4/2009 Zhang et al.
7,554,781 B1 * 6/2009 Weeks et al. ..... 361/42
7,612,973 B2 11/2009 Germain
2004/0021996 A1 2/2004 Wu et al.
2004/0027740 A1 2/2004 Huang et al.
2004/0037018 A1 2/2004 Kim
2004/0070897 A1 4/2004 Wu et al.
2005/0140476 A1 * 6/2005 Gao ..... 335/18
2005/0264383 A1 12/2005 Zhang
2006/0139132 A1 6/2006 Porter et al.
2008/0186642 A1 8/2008 Campolo et al.
2009/0086390 A1 * 4/2009 Huang ..... 361/49
2009/0147418 A1 6/2009 Li et al.
2009/0161271 A1 * 6/2009 Huang et al. ..... 361/42

* cited by examiner

DISCONNECT MECHANISM IN A POWER RECEPTACLE WITH GROUND-FAULT CIRCUIT INTERRUPTION FUNCTIONS

This application claims foreign priority benefits under 35 U.S.C. §119(a)-(d) from China Patent Application No. 200820057228.4, filed Apr. 14, 2008, which is incorporated by reference in its entirety.

BACKGROUND OF THE INVENTION

1. Field of the Invention

This invention relates to a power receptacle with ground-fault circuit interrupter (GFCI) functions, and in particular, it relates to a disconnect mechanism in the power receptacle.

2. Description of the Related Art

When electrical appliances have a current leakage, abnormal current or voltage signals are generated. Leakage current protection devices can detect such abnormal current or voltage signals and used an operating mechanism to automatically cut off the power supply to the leaking appliances.

GFCI is a power receptacle that has a leakage current protection function. Their current limit is typically below 20 A and can detect leakage current of 6-30 mA. GFCIs are often used in handheld appliances, portable appliances, and are often used in homes, schools, etc.

A typical current type leakage current detection and protection devices includes a detection circuit (residual current detection), an intermediate mechanism (amplifier, comparator, or disconnecting mechanism), actuator and testing mechanism. A GFCI typically uses a disconnect mechanism as the intermediate mechanism.

Disconnect mechanisms can be categorized into electronic and electromagnetic types. Electromagnetic type disconnect mechanisms is widely used because it is more resistant to interference and shock (over current and over voltage), does not require auxiliary power supply, and does not change its protection functions at zero voltage.

Conventional GFCIs have certain shortcomings. For example, the GFCI described in Chinese patents ZL00250313.1 and ZL02243496.8, each moveable contact arm has one fixed end and another end with a contact terminal, so the connection and disconnection of the input and output ends of the receptacle relies on the resilient nature of the moving arms. However, the uniformity of the resilience of the moving arms is difficult to control during manufacturing, and cannot be tested using destructive test. Thus, if a moving arm is defective in its resilience, and if the load side experience an ultra-low ground fault (e.g. over 1000 A of leakage current), arcs may occur when the contact terminals are disconnected, which may melt the contact terminals and fuse them together. Thus, even though the disconnect mechanism of the GFCI is functional, the contact terminals are in fact not disconnected. This presents great hidden danger to safety.

SUMMARY OF THE INVENTION

The present invention is directed to an improved GFCI power receptacle.

An object of the present invention is to provide a disconnect mechanism, which includes an auxiliary disconnecting device to cooperate with an actuator, as well as an auxiliary switch. When a leakage occurs in the GFCI, the disconnect mechanism can quickly and effectively cut off the power supply automatically. Even when the contact terminals are melted and fused together due to large current, the auxiliary disconnect device can effectively increase the force on the contact points to separate them so as to ensure disconnection of the electrical coupling.

Additional features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, the present invention provides a disconnect mechanism for a power receptacle, which includes a disconnect block, a locking member slidably coupled to the disconnect block, and an electromagnetic device moveably coupled to the locking member. The disconnect block includes two side arms extending outwards. A pressing plate is disposed above the disconnect block, and a disconnect spring is disposed above the pressing plate.

The pressing plate has a concave lower surface facing the corresponding side arms of the disconnect block. Optionally, the upper surface of the side arms also has a concave shape. Preferably, the concave lower surface of the pressing plate and the concave upper surface of the side arms have a cylindrical shape.

The disconnect mechanism includes an auxiliary switch disposed below the disconnect block. The auxiliary switch includes a moving contact arm and a stationary contact arm. The pressing plate has two arms on a side facing the corresponding side arms of the disconnect block, the arms extending beyond the side arms of the disconnect block to a location adjacent the moveable contact arm of the auxiliary switch.

In another aspect, the present invention provides a ground-fault circuit interrupter (GFCI) receptacle, which includes a body and a circuit board disposed in the body. On the circuit board are mounted a pair of output moveable contact arms, a pair of input stationary contact arms, a reset switch, and a disconnect mechanism which includes a disconnect block, a locking member and an electromagnetic device. Also disposed inside the body are a reset mechanism, a test mechanism, and a pair of output conductors with contact terminals thereon.

The pair of input stationary contact arms each has one end partially inserted into the electromagnetic device and the other end provided with contact terminals. The pair of output moveable contact arms are formed of four resilient metal plates arranged in parallel with a contact terminal formed on the free end of each metal plate. The disconnect block is disposed below the pair of output moveable contact arms, and has two side arms extending outwards. A pressing plate is disposed above the disconnect block and is coupled to the disconnect block. A disconnect spring disposed above the pressing plate.

It is to be understood that both the foregoing general description and the following detailed description are exemplary and explanatory and are intended to provide further explanation of the invention as claimed.

The pressing plate has a concave lower surface facing the corresponding side arms of the disconnect block. Optionally, the upper surface of the side arms also has a concave shape. Preferably, the concave lower surface of the pressing plate and the concave upper surface of the side arms have a cylindrical shape.

The disconnect mechanism includes an auxiliary switch mounted on the circuit board and disposed below the disconnect block. The auxiliary switch includes a moving contact arm and a stationary contact arm each having a contact terminal formed thereon.

The pressing plate has two arms on a side facing the corresponding side arms of the disconnect block, the arms extending beyond the side arms of the disconnect block to a location adjacent the moveable contact arm of the auxiliary switch.

The GFCI receptacle further includes an arc blocking plate disposed between the circuit board and the pair of input stationary contact arms to block arcs generated when the contact terminals are separating from each other. The arc blocking plate may be made of an arc-resistant material, such as PVC, GPO-3 laminated boards, etc.

Further, the GFCI receptacle includes a reset button, a reset shaft attached to the reset button, and a reset spring disposed around the reset shaft. The reset shaft passes through a through hole on the pressing plate, a through hole on the disconnect block and a through hole of the locking member. The disconnect spring is disposed around the reset shaft and below the reset spring.

Preferably, the disconnect spring is separated from the reset spring.

The disconnect mechanism according to embodiments of the present invention has many advantages. First, the disconnect mechanism and the receptacle has a simple structure, is safe and easy to use. Because the pressing plate is coupled to and cooperate with the disconnect block, the structure is compact and can be used in various types of receptacles.

Second, the disconnect mechanism and the receptacle employs the pressing plate and the disconnect spring, enhancing the backing force provided by pressing plate to the output moving contact arms.

Third, the disconnect mechanism and the receptacle employs an auxiliary switch disposed below the disconnect block and mounted on the circuit board, such that when leakage occurs, the electrical connection is broken. This prevents damage to the disconnecting coil by a large current flowing through the device for a long period of time.

BRIEF DESCRIPTION OF THE DRAWINGS

The features and advantages of the preferred embodiments can be further understood from the detailed description below with reference to the following drawings.

DETAILED DESCRIPTION OF THE PREFERRED EMBODIMENTS

Figure 1:
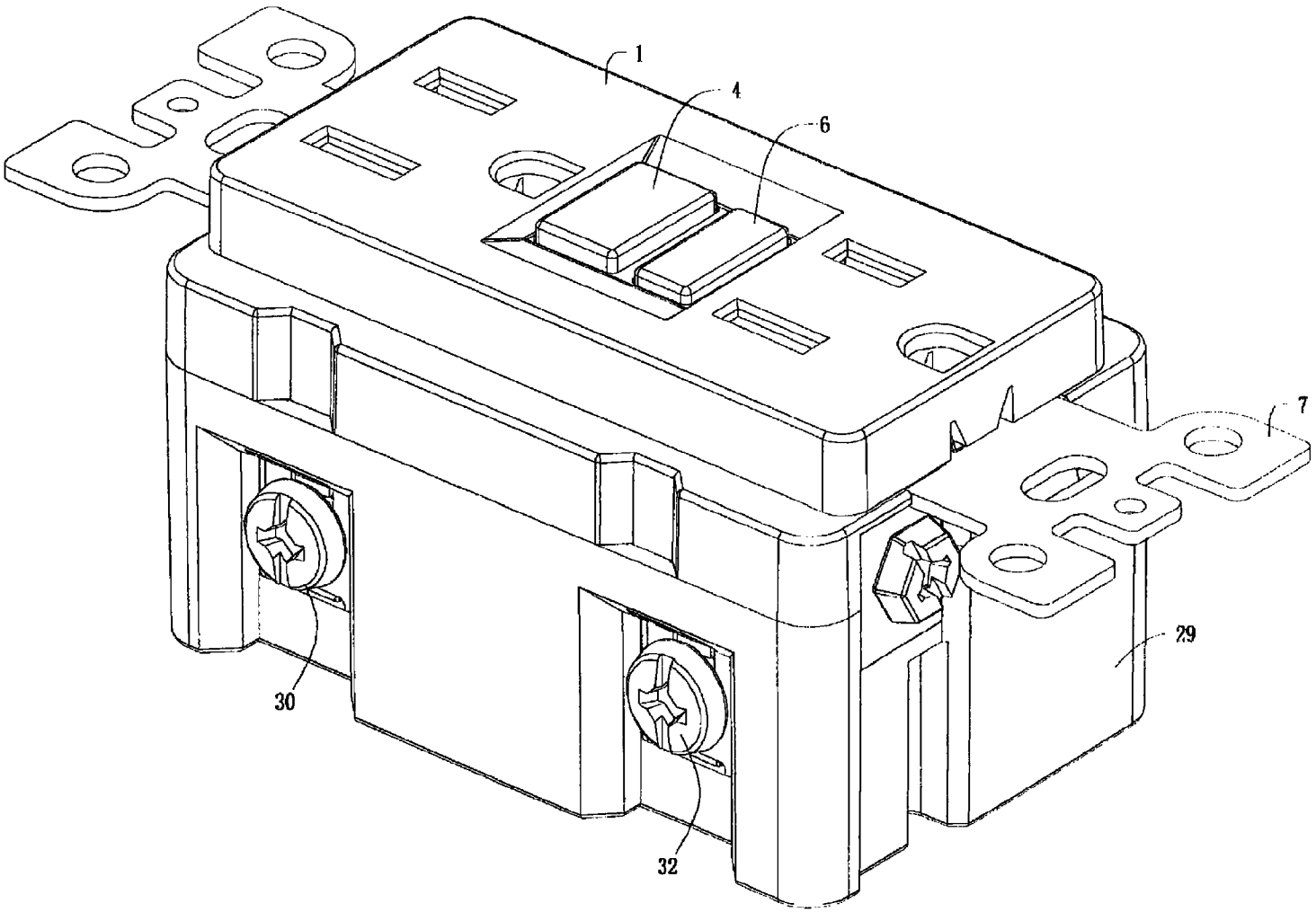
FIG. 1 is an external perspective view of a GFCI according to an embodiment of the present invention.

The following symbols are used in the drawing:

1: Top cover
2, 3: Tamper resistant mechanism
4: Reset button
5: Reset shaft
51: Locking slot
6: Test button
7: Grounding frame assembly
71, 72: Grounding plates
8: Disconnect spring
9: Disconnect pressing plate
91, 92: Arms of the pressing plate
93, 94: Concave surfaces of the pressing plate
95: Sleeve of the pressing plate
96: Through hole of the disconnect pressing plate
10, 11: Output moveable contact arms
101, 102, 111, 112: Output moveable contact terminals
12: Locking member
121: Through hole of the locking member
122: Coupling slot
13: Disconnect block
131, 132: Side arms of the disconnect block
133, 134: Slots on the side arms of the disconnect block
135, 136: Concave surfaces of the side arms of the disconnect block
137: Through hole of the disconnect block
138: Slot in the disconnect block for accommodating the locking member
14: Spring for the disconnecting plunger
15: Disconnecting plunger
16: Disconnecting coil frame
161: Disconnecting coil
17: Auxiliary moveable contact arm
171: Auxiliary moveable contact terminal
18: Auxiliary stationary contact arm
181: Auxiliary stationary contact terminal
19: Middle support frame
20, 21: Output conductors
201, 211: Contact terminals of output conductors
202, 212: Metal plates of the output conductors
22: Reset spring
23: Test plate
24: Circuit board
25: Reset switch
251: Moveable contact of the reset switch
252: Stationary contact of the reset switch
26: Electromagnetic ring assembly
27, 28: Input stationary contact arms
271, 281: Input stationary contact terminals
29: Base frame
30, 31: Output terminals of the receptacle
32, 33: Input terminals of the receptacle
34: Screws
35: Arc blocking plate The operating principle of the electromagnetic type GFCI circuit is briefly described with reference to FIG. 6.

When the GFCI is operating normally, when the reset button is pressed and the reset switch (SW1) is closed a control signal is generated to cause the silicon-controlled rectifiers (SCRs) (Q1 and Q2) to become conductive. As a result, a current passes through and energizes the solenoid (SOL). The solenoid cooperates with a disconnect assembly and a locking member to bring the contact terminals of the main switch (RESET) into contact, whereby the input (LINE) and output (LOAD and RECEPTACLE) ends of the receptacle are electrically connected.

When there is leakage in the receptacle, the electromagnetic ring assembly detects the leakage current, causing the SCRs to conduct. The solenoid is energized and operates the disconnect assembly and the locking member to be unlocked and released, breaking electrical connection of the main switch (RESET). The leakage current protection operation is fast and sensitive, protecting the safety of users.

The GFCI according to embodiments of the present invention is an improvement based on the general operating principle described above. As illustrated in FIG. 1, the GFCI receptacle includes a body formed of a top cover 1 and a base frame 29, where the top cover is provided with openings for plugs and openings for a reset button 4 and a test button 6.

Figure 2:
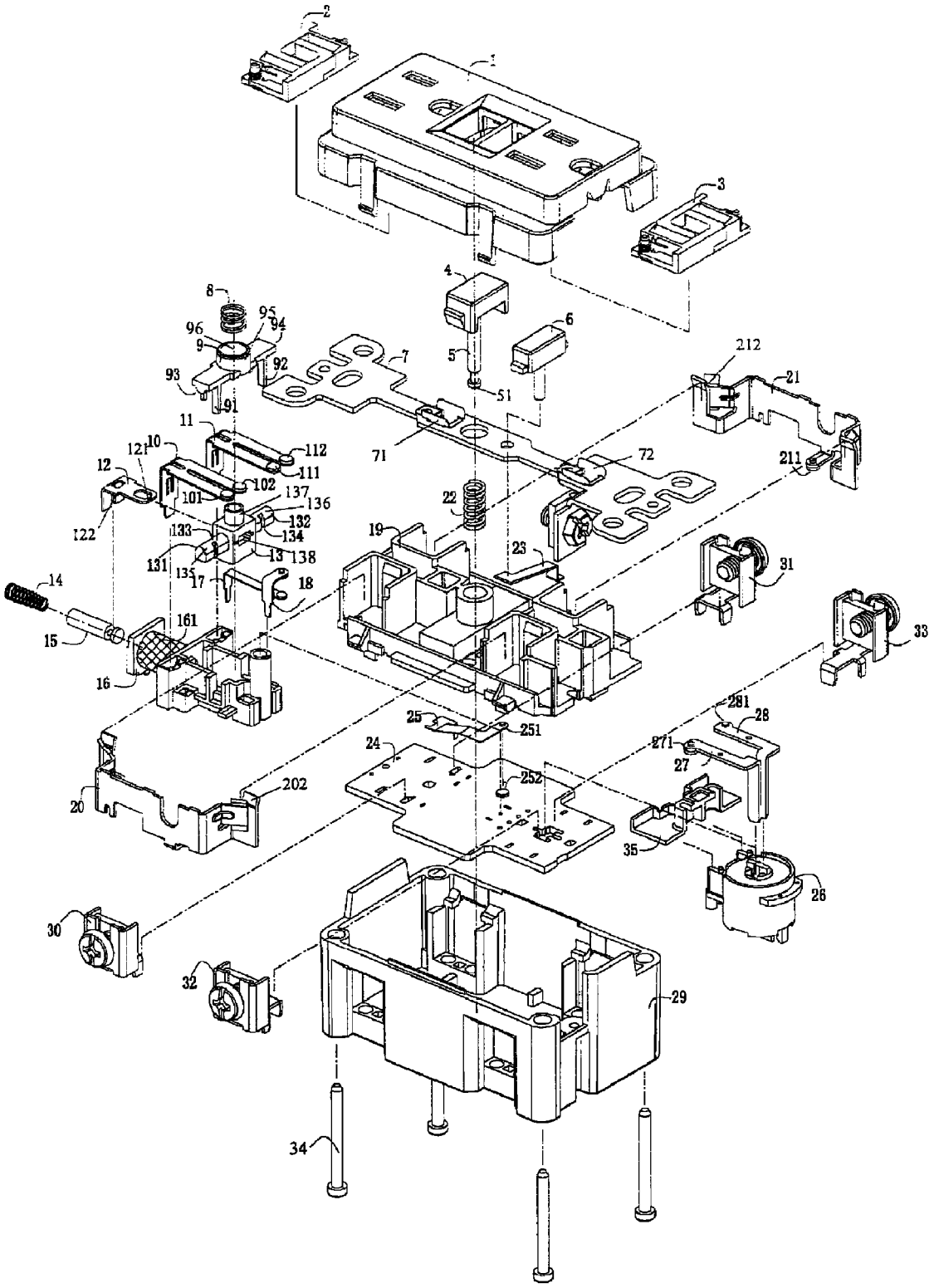
FIG. 2 is an exploded view of the GFCI according to an embodiment of the present invention.

The exploded perspective view FIG. 2 illustrates the internal structure of the receptacle. As seen in FIG. 2, inside the body is a middle support frame 19. Between the top cover 1 and the middle support frame 19 is a grounding frame assembly 7; between middle support frame 19 and the base frame 29 is a circuit board 24.

Grounding plates 71 and 72 are provided on the grounding frame assembly 7, which are coupled to the ground legs and aligned with corresponding plug holes on the top cover 1. On two sides of the middle support frame 19 are output conductors 20 and 21, which are provided with metal plates 202, 212 aligned with corresponding plug holes on the top cover 1, as well as contacts 201, 211.

Figure 3A:
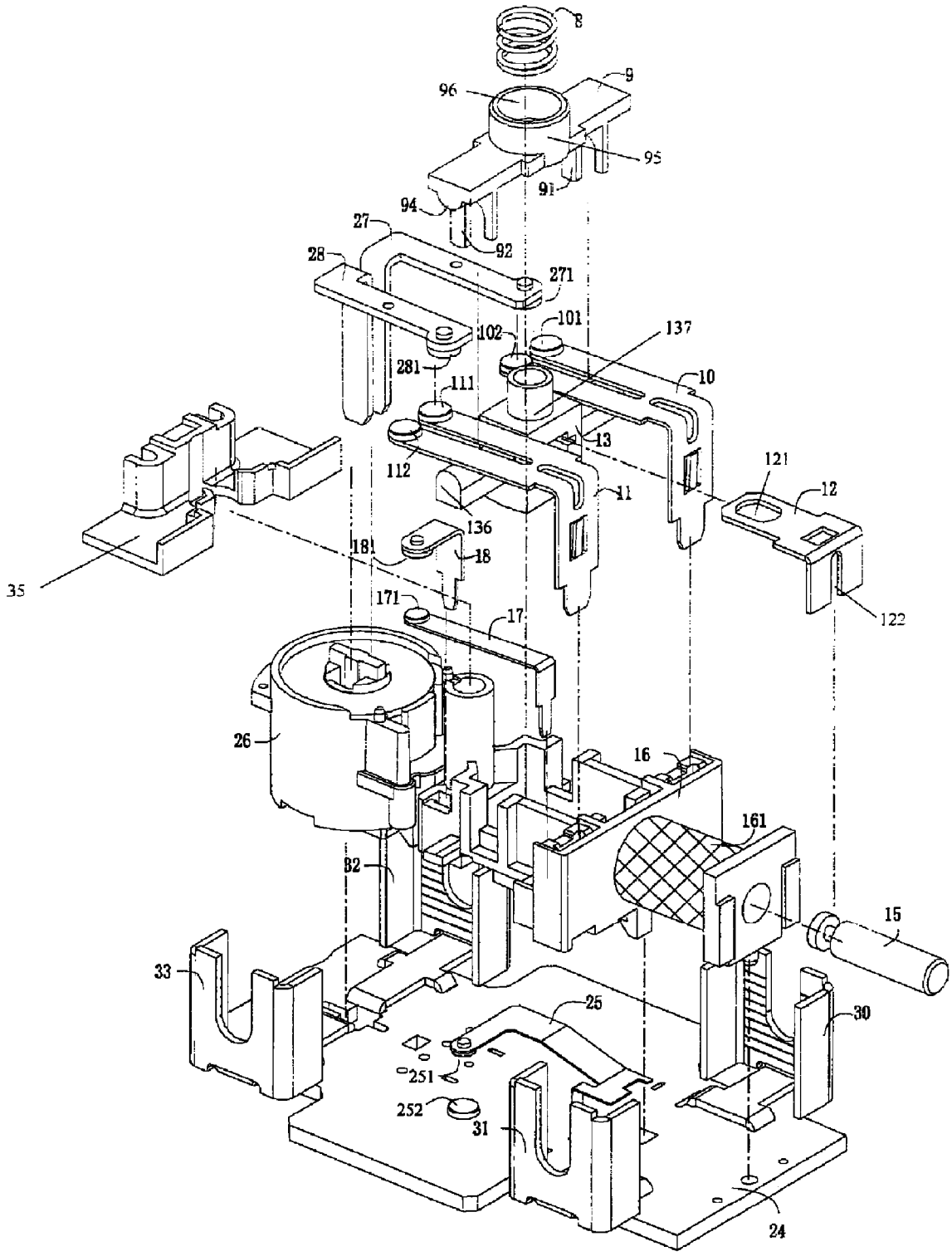
FIG. 3*a* is an exploded view of a part of the GFCI of FIG. 2.
Figure 3B:
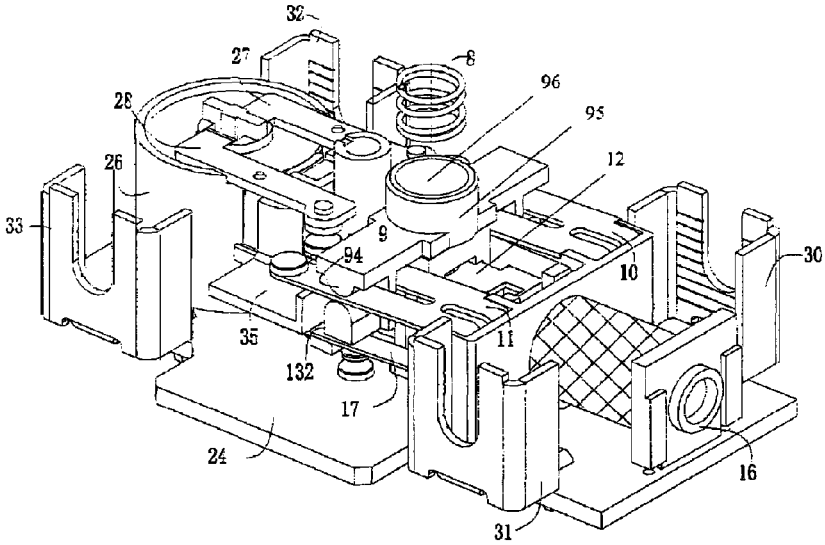
FIG. 3*b* is a perspective view of the part in FIG. 3*a* in an assembled state.

Disposed on the circuit board 24 are: a pair of output moveable contact arms 10, 11; a pair of input stationary contact arms 27, 28; reset switch 25; and a disconnect assembly that includes a disconnect block 13, a locking member 12 and electromagnetic components. The electromagnetic components include an electromagnetic ring assembly 26, a disconnecting coil frame 16, disconnecting coil 161 on the frame 16, a disconnecting plunger 15 inside the coil 161, and a spring 14 that is biased against the disconnecting plunger 15. The pair of input stationary contact arms 27, 28 are stationary, with their one ends inserted into the electromagnetic ring assembly 26, while their other ends are provided with input stationary contact terminals 271, 281. The pair of output moveable contact arms 10, 11 are moveable, and include four parallel resilient metal plates where the free ends of the resilient metal plates are provided with moveable contact terminals 101, 102, 111, 112. The disconnect block 13 is disposed below the pair of output moveable contact arms 10, 11. The disconnect block 13 has two side arms 131, 132 extending outwardly. Above the output moveable contact arms 10, 11 is a disconnect pressing plate 9 that cooperates with the disconnect block 13. A disconnect spring 8 is fixedly attached to the pressing plate 9 at its top. To protect the electronic components on the circuit board from arcs generated when the various contact terminals are separated from each other, an arc blocking plate 35 is provided between the circuit board 24 and the pair of input stationary contact arms 27, 28 as shown in FIGS. 2-3*b*. The structure of the arc blocking plate 35 is not limited to the one shown in the figures. The arc blocking plate may be made of an arc-resistant material, such as PVC, GPO-3 laminated boards (a fiberglass reinforced thermoset polyester molded material) and other insulating materials, etc.

As seen in FIGS. 2-3*b*, in the preferred embodiment, the structure of pressing plate 9 is an elongated plate shape that corresponds to the shape of the disconnect block 13. It should be understood that any suitable structure of the pressing plate 9 may be used so long as it can cooperate with the disconnect block 13 to provide a backing force for the output moveable contact arms 10, 11. On the bottom side of the pressing plate 9 and the top side of the side arms 131, 132 of the disconnect block 13, there may be provided concave surfaces 93, 94 and concave surfaces 135, 136, respectively, in order to enhance the sensitivity of pinching action upon the output moveable contact arms 10, 11. Further, the bottom of the pressing plate 9 has U-shaped arms 91, 92 extending downwardly, which are positioned to be around the side arms 131, 132 of the disconnect block 13 to help the cooperation of the pressing plate 9 and the disconnect block 13. One branch of the U-shaped arms 91, 92 are coupled to the disconnect block 13 by fitting into slots 133, 134 on the side arms 131, 132; the other branch of the U-shaped arms 91, 92 extend beyond the side arms 131, 132 to contact an auxiliary moveable contact arm 17 of an auxiliary switch. The auxiliary switch, which is mounted on the circuit board 24, has an auxiliary stationary contact arm 18 corresponding to the auxiliary moveable contact arm 17, with an auxiliary moveable contact terminal 171 and an auxiliary stationary contact terminal 181 on the arms 17 and 18, respectively.

On the pressing plate 9, the disconnect block 13 and the locking member 12, through holes 96, 137 and 121 are provided, respectively, for the reset shaft 5 to pass through. The reset shaft 5 is attached to the reset button 4 and has a reset spring 22 around it. The disconnect spring 8 is disposed above the pressing plate 9, in a sleeve 95 that extends coaxially above the through hole 96. The disconnect spring 8 can also be fixedly coupled the pressing plate 9. To more reliably couple the pressing plate 9 and the disconnect block 13, another sleeve may be formed on the disconnect block 13 extending coaxially above the through hole 137 and inserted into the through hole 96 of the pressing plate 9. The coupling of the pressing plate 9 and the disconnect block 13 is not limited to the structures described here. Also, the disconnect spring 8 may be disposed around the reset shaft 5, separated from the reset spring 22, as shown in FIGS. 4*a*-5*b*.

Provided on the disconnect block 13 is a slot 138 for accommodating the locking member 12. The locking member 12 preferably has an L shape. The horizontal part of the L shape has the through hole 121 and is disposed in the slot 138; the substantially vertical part has a coupling slot 122 for coupling to the disconnecting plunger 15, so that the locking member 12 moves with the plunger 15.

The reset switch 25 is disposed on the circuit board 24, and includes a stationary contact 252 soldered on the circuit board and a moveable contact 251 formed on a resilient metal plate soldered to the circuit board.

Since the GFCI is a protective device, periodic testing is necessary to make sure it is functioning properly. For this purpose, a test plate 23 is provided because the output conductor 21 and the test button 6 to form a testing mechanism. The test switch and a resistor form a simulated leakage current circuit to test whether the circuit interrupter is functioning properly.

Further, tamper resistance devices 2 and 3 may be provided between the top cover 1 and the grounding frame assembly 7. Output terminals 30, 31 and input terminals 32, 33 of the receptacle are located on both sides of the base frame 29. Finally, screws 34 fasten the top cover 1, the middle support frame 19 and the base frame 29 together to form the assembled receptacle.

Figure 4A:
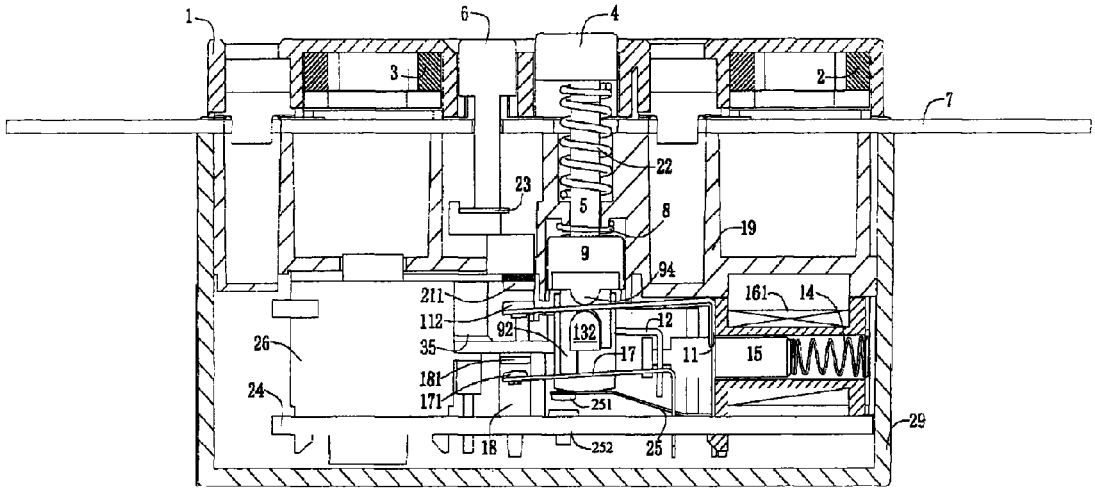
FIGS. 4*a*-4*b* are cross-sectional views of the GFCI in a reset state.
Figure 4B:
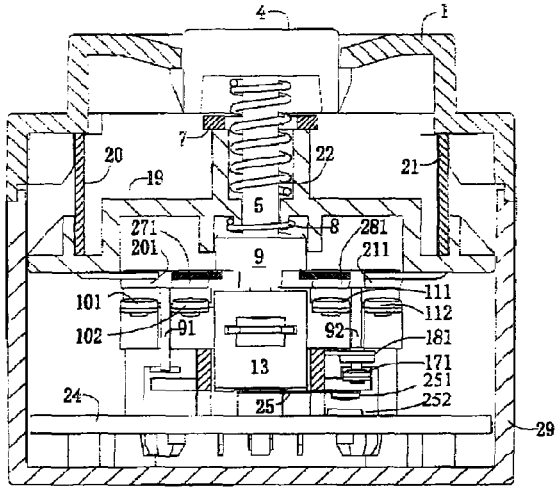

The operation of the GFCI device is described with reference to the figures. Referring to FIGS. 4*a* and 4*b*, the receptacle is shown in a normally functioning, reset condition. When the reset button 4 is pressed down, the reset shaft moves downward and compresses the reset spring 22. At the same time, the pressing plate 9 and the disconnect block 13 move downward, so that the moveable contact 251 and the stationary contact 252 of the reset switch 25 contact each other. The closing of the reset switch 25 causes a current through the disconnecting coil 161, and the magnetic field of the coil 161 causes the plunger 15 to move. The locking member 12 moves with the plunger 15, and the locking slot 51 of the reset shaft 5 passes through the hole 121 of the locking member 12.

Then, the reset switch 25 automatically disconnects due to its resilience, and the coil 161 is de-energized. As a result, the plunger 15 moves back due to the biasing force of the spring 14, bringing the locking member 12 with it, causing the locking slot 51 of the reset shaft 5 to engage the locking member 12 and lock the reset shaft 5. Then, when the pressing force on the reset button is released, the reset spring 22 urges the reset shaft 5 to move upwards. At this time, because the reset shaft 5 is locked with the locking member 12, the reset shaft 5 brings the locking member 12, the disconnect block 13 and the pressing plate 9 upwards. The side arms 131, 132 of the disconnect block 13 pushes the output moveable contact arms 10, 11 upwards, causing the output moveable contact terminals 102, 111 to come in contact with input stationary contact terminals 271, 281, and the output moveable contact terminals 101, 112 to come in contact with contact terminals 201, 211 of the output conductors 20, 21. As a result, the input side and the output side of the receptacle are electrically connected. It should be noted that the arms 91, 92 of the pressing plate 9 are in contact with the auxiliary moveable contact arm 17 before reset; after reset, because the arms 91, 92 of the pressing plate 9 move upwards, the auxiliary moveable contact terminal 171 and the auxiliary stationary contact terminal 181 come into contact with each other, which closes the auxiliary switch 17/18.

Figure 5A:
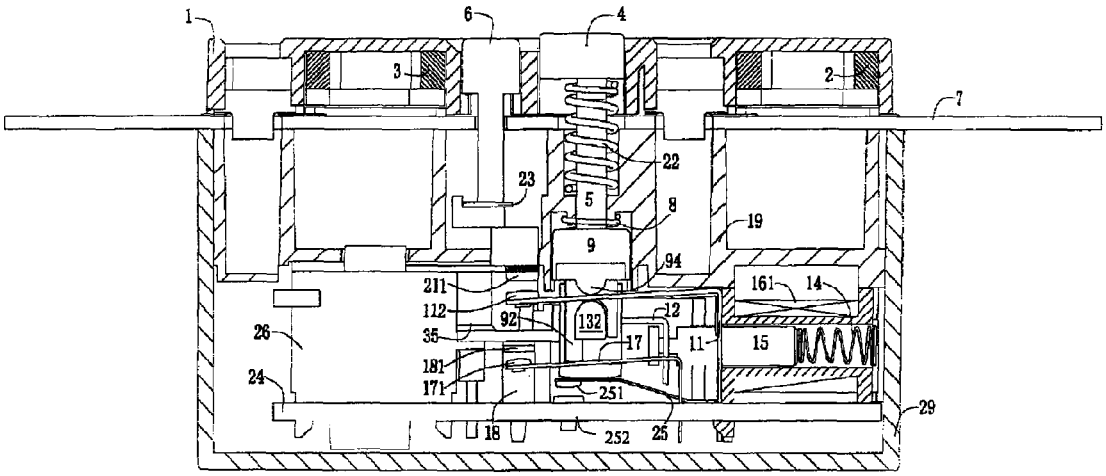
FIGS. 5*a*-5*b* are cross-sectional views of the GFCI in a tripped state.
Figure 5B:
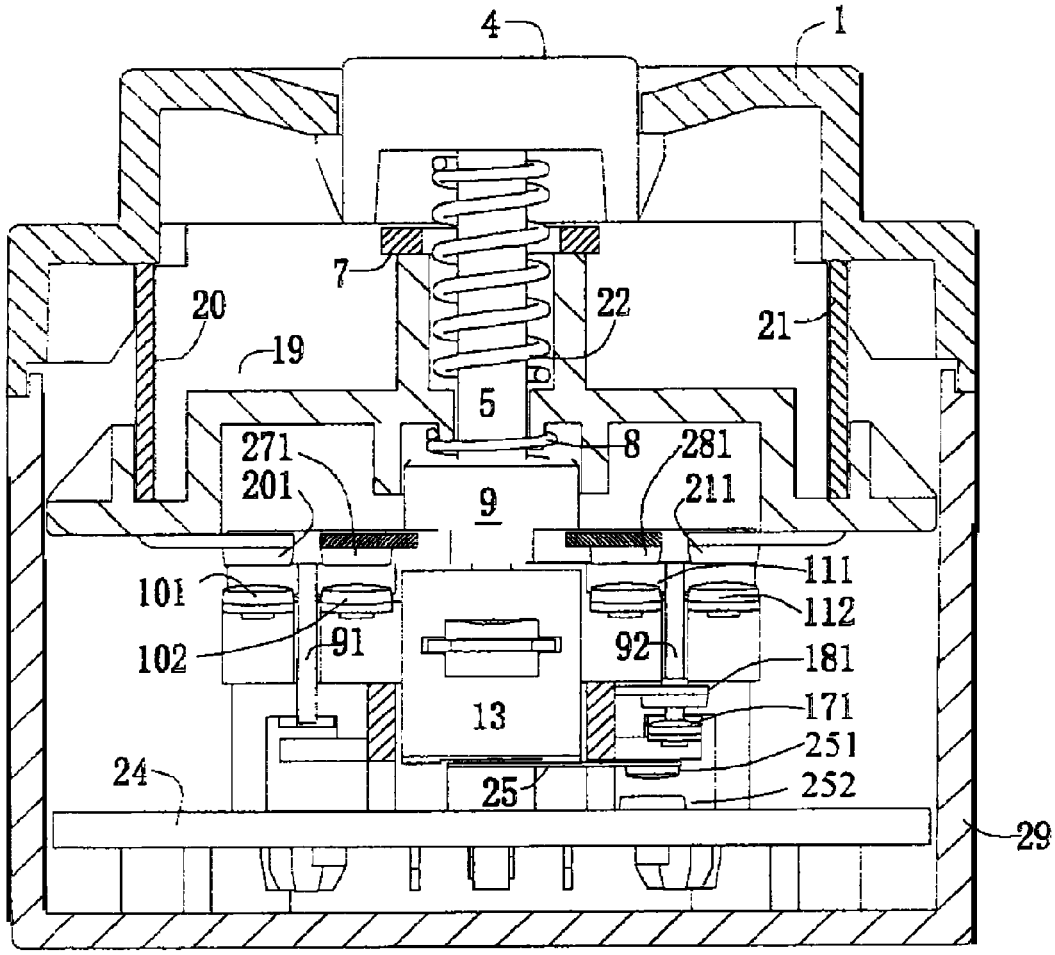

As shown in FIGS. 5*a*-5*b*, when current leakage occurs within the receptacle, the electromagnetic ring assembly detects the leakage and generates an electromagnetic field in the disconnecting coil 161. The disconnecting plunger 15 pushes the locking member 12 to move, so that the locking slot 51 of the reset shaft 5 escapes from the through hole 121 of the locking member 12 and moves upwards by the force of the reset spring 22. As a result, the pressing plate 9 and the disconnect block 13 falls downwards. The disconnect spring 8, which has been previously compressed by the pressing plate 9, forces the pressing plate 9 to move downwardly quickly. The pressing plate 9 pushes the output moveable contact arms 10, 11 downwardly, causing the output moveable contact terminals 102, 111 to be separated from the input stationary contact terminals 271, 281, and causing the output moveable contact terminals 101, 112 to be separated from the contact terminals 201, 211 of the output conductors 20, 21, respectively. As a result, the electrical connection between input side and the output side of the receptacle is quickly disconnected, providing enhanced safety protection to the users.

Figure 6:
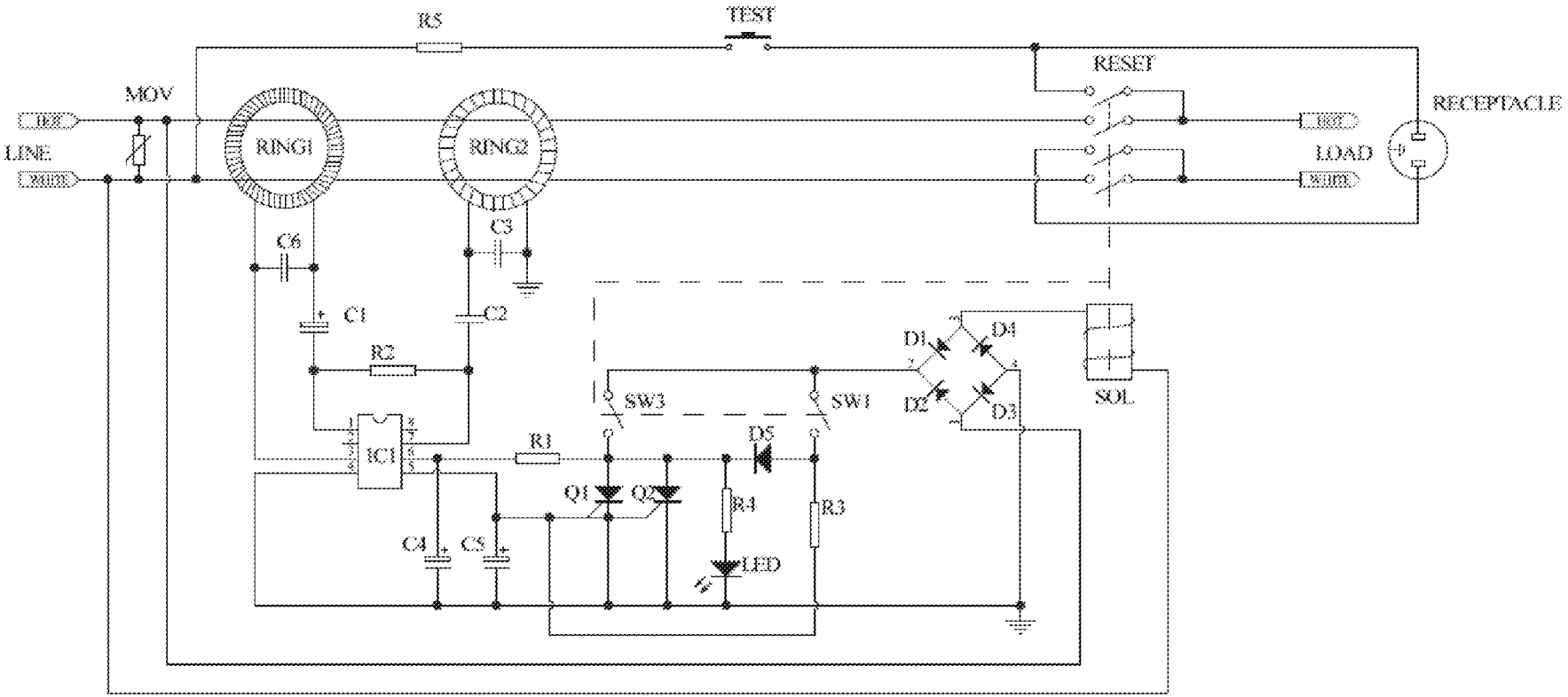
FIG. 6 is a circuit diagram of the GFCI.

Also, because the pressing plate 9 moves downwards quickly, the arms 91, 92 of the pressing plate 9 re-establishes contact with the auxiliary moveable contact arm 17 and presses it down, the auxiliary moveable contact terminal 171 is separated from the auxiliary stationary contact terminal 181, so the auxiliary switch 17/18 is open. In FIG. 6, the auxiliary switch is shown as SW3.

The testing operation of the GFCI is described now. When the GFCI is working properly and the test button 6 is pressed, the test plate 23 is pressed down to close a test current loop (which includes a test resistor) to simulate a leakage current. Thus, the disconnecting coil 161 is energized and the plunger 15 moves the locking member 12. The locking slot 51 escapes from the through hole 121 of the locking member 12, the disconnect spring 8 quickly pushes the pressing plate 9 down to disconnect the input side and output side of the receptacle. When this testing procedure is finished and the GFCI is determined to be functioning properly, pressing the reset button 4 again will establish the electrical connection between the input and output sides of the receptacle.

It will be apparent to those skilled in the art that various modification and variations can be made in the power receptacle of the present invention without departing from the spirit or scope of the invention. Thus, it is intended that the present invention cover modifications and variations that come within the scope of the appended claims and their equivalents.

What is claimed is:

1. A ground-fault circuit interrupter (GFCI) receptacle, comprising:

a circuit board;

a pair of output moveable contact arms mounted on the circuit board, the pair of output moveable contact arms being formed of four resilient metal plates arranged in parallel with a contact terminal formed on a free end of each metal plate;

a pair of input stationary contact arms mounted on the circuit board, each having a first end with a contact terminal, wherein the two contact terminals of the input stationary contact arms correspond in position with two of the four contact terminals of the output moveable contact arms;

a pair of output conductors having contact terminals disposed thereon which correspond in position with the other two of the four contact terminals of the output moveable contact arms;

a reset switch mounted on the circuit board;

a reset mechanism;

a test mechanism;

a disconnect block having two side arms disposed below the pair of output moveable contact arms;

a pressing plate disposed above the disconnect block;

a disconnect spring disposed above the pressing plate;

a locking member slidably coupled to the disconnect block;

an electromagnetic device moveably coupled to the locking member, wherein each input stationary contact arm has a second end partially inserted into the electromagnetic device, wherein the plurality of output moveable contact arms are partially disposed between the pressing plate and the corresponding side arms of the disconnect block, wherein when the electromagnetic device is energized, it moves the locking member in a first direction, wherein when the locking member moves in the first direction, the disconnect block and the pressing plate move in a second direction under a force of the disconnect spring, wherein when the pressing plate and the disconnect block move in the second direction, the pressing plate presses the plurality of output moveable contact arms in the second direction to break a contact between the contact terminals of the output moveable contact arms and the contact terminals of the input stationary contact arms and the output conductors, and an arc blocking plate disposed between the circuit board and the pair of input stationary contact arms to block arcs generated when the contact between the contact terminals of the output moveable contact arms and the contact terminals of the input stationary contact arms and the output conductors are broken.

2. The GFCI receptacle of claim 1, wherein the pressing plate have concave surfaces facing the corresponding side arms of the disconnect block.

3. The GFCI receptacle of claim 1, further comprising an auxiliary switch mounted on the circuit board, the auxiliary switch being disposed under the disconnect block, the auxiliary switch including a moveable contact arm with a contact terminal thereon and a stationary contact arm with a contact terminal thereon.

4. The GFCI receptacle of claim 3, wherein the pressing plate has two arms on a side facing the corresponding side arms of the disconnect block, the arms extending beyond the side arms of the disconnect block to a location adjacent the moveable contact arm of the auxiliary switch.

5. The GFCI receptacle of claim 1, wherein the reset mechanism includes:

a reset button;

a reset shaft attached to the reset button; and a reset spring disposed around the reset shaft, wherein the reset shaft passes through a through hole on the pressing plate, a through hole on the disconnect block and a through hole of the locking member, wherein the disconnect spring is disposed around the reset shaft and below the reset spring.

6. The GFCI receptacle of claim 5, wherein the disconnect spring is separated from the reset spring.

7. The disconnect mechanism of claim 1, wherein the plurality of moveable contact arms are electrically connected to the output side of the receptacle.

* * * * *